US011019414B2

(12) United States Patent
McElveen et al.

(10) Patent No.: US 11,019,414 B2
(45) Date of Patent: May 25, 2021

(54) WEARABLE DIRECTIONAL MICROPHONE ARRAY SYSTEM AND AUDIO PROCESSING METHOD

(71) Applicant: Wave Sciences, LLC, Charleston, SC (US)

(72) Inventors: James Keith McElveen, Charleston, SC (US); Gregory S. Nordlund, Jr., Charleston, SC (US); Leonid Krasny, Cary, NC (US)

(73) Assignee: Wave Sciences, LLC, Charleston, SC (US)

( * ) Notice: Subject to any disclaimer, the term of this patent is extended or adjusted under 35 U.S.C. 154(b) by 0 days.

(21) Appl. No.: 16/836,726

(22) Filed: Mar. 31, 2020

(65) Prior Publication Data

US 2020/0296492 A1 Sep. 17, 2020

Related U.S. Application Data

(63) Continuation-in-part of application No. 14/561,433, filed on Dec. 5, 2014, now Pat. No. 10,609,460, (Continued)

(51) Int. Cl.
*H04R 1/00* (2006.01)
*H04R 1/02* (2006.01)
(Continued)

(52) U.S. Cl.
CPC ..... *H04R 1/02* (2013.01); *H04R 3/005* (2013.01); *H04R 1/1083* (2013.01); (Continued)

(58) Field of Classification Search
CPC . H04R 1/02; H04R 1/04; H04R 1/406; H04R 1/1083; H04R 3/005; H04R 25/405; (Continued)

(56) References Cited

U.S. PATENT DOCUMENTS 5,737,430 A * 4/1998 Widrow ..... H04R 25/407 381/312
5,906,004 A * 5/1999 Lebby ..... A41D 31/00 2/1

(Continued)

*Primary Examiner* — Matthew A Eason
(74) *Attorney, Agent, or Firm* — Gregory Finch; Finch Paolino, LLC

(57) ABSTRACT

A wearable microphone array apparatus and system used as a directional audio system and as an assisted listening device. The present invention advances hearing aids and assisted listening devices to allow construction of a highly directional audio array that is wearable, natural sounding, and convenient to direct, as well as to provide directional cues to users who have partial or total loss of hearing in one or both ears. The advantages of the invention include simultaneously providing high gain, high directivity, high side lobe attenuation, and consistent beam width; providing significant beam forming at lower frequencies where substantial noises are present, particularly in noisy, reverberant environments; and allowing construction of a cost effective body-worn or body-carried directional audio device.

20 Claims, 8 Drawing Sheets

Related U.S. Application Data which is a continuation of application No. 13/654,225, filed on Oct. 7, 2012, now Pat. No. 9,402,117.

(51) Int. Cl.
*H04R 3/00* (2006.01)
*H04R 1/10* (2006.01)
*H04R 25/00* (2006.01)

(52) U.S. Cl.
CPC ..... *H04R 25/405* (2013.01); *H04R 2201/023* (2013.01); *H04R 2201/405* (2013.01); *H04R 2430/23* (2013.01)

(58) Field of Classification Search
CPC ..... H04R 25/407; H04R 2201/023; H04R 2201/405; H04R 2430/23; H04R 29/005
See application file for complete search history.

(56) References Cited

U.S. PATENT DOCUMENTS 6,080,690 A * 6/2000 Lebby ..... D03D 15/258 442/209
6,583,768 B1 * 6/2003 Underbrink ..... H01Q 9/27 343/893
6,729,025 B2 * 5/2004 Farrell ..... B32B 3/08 29/825
7,783,061 B2 * 8/2010 Zalewski ..... H04R 3/005 381/92
10,638,248 B1 * 4/2020 Dodds ..... G10K 11/17813
2006/0245601 A1 * 11/2006 Michaud ..... H04R 3/005 381/92
2007/0055505 A1 * 3/2007 Doclo ..... G10L 21/0208 704/226
2007/0274534 A1 * 11/2007 Lockhart ..... H04R 25/407 381/92
2009/0034756 A1 * 2/2009 Volker ..... G10L 21/0272 381/119
2009/0167884 A1 * 7/2009 Connell, Jr. ..... H04N 5/3696 348/222.1
2010/0076756 A1 * 3/2010 Douglas ..... G10L 21/0216 704/226
2012/0243716 A1 * 9/2012 Puder ..... H04R 25/453 381/318
2015/0086039 A1 * 3/2015 McElveen ..... H04R 1/02 381/92
2018/0330745 A1 * 11/2018 Ebenezer ..... H04R 1/1083
2019/0385635 A1 * 12/2019 Shahentov ..... G10L 25/21
2020/0296492 A1 * 9/2020 McElveen ..... H04R 29/005

* cited by examiner

WEARABLE DIRECTIONAL MICROPHONE ARRAY SYSTEM AND AUDIO PROCESSING METHOD

CROSS-REFERENCE TO RELATED APPLICATIONS

The present application is a continuation-in-part of U.S. patent application Ser. No. 14/561,433 filed on Dec. 5, 2014 and titled "WEARABLE DIRECTIONAL MICROPHONE ARRAY APPARATUS AND SYSTEM," assigned to the assignee of the present invention; said application being a continuation of U.S. patent application Ser. No. 13/654,225 filed on Oct. 17, 2012, now U.S. Pat. No. 9,402,117, and titled "WEARABLE DIRECTIONAL MICROPHONE ARRAY APPARATUS AND SYSTEM," assigned to the assignee of the present invention; each of these applications being hereby incorporated at least by reference in their entireties.

FIELD

The present invention is in the technical field of directional audio systems, in particular, microphone arrays used as directional audio systems and microphone arrays used as assisted listening devices and hearing aids.

BACKGROUND

Directional audio systems work by spatially filtering received sound so that sounds arriving from the look direction are accepted (constructively combined) and sounds arriving from other directions are rejected (destructively combined). Effective capture of sound coming from a particular spatial location or direction is a classic but difficult audio engineering problem. One means of accomplishing this is by use of a directional microphone array. It is well known by all persons skilled in the art that a collection of microphones can be treated together as an array of sensors whose outputs can be combined in engineered ways to spatially filter the diffuse (i.e. ambient or non-directional) and directional sound at the particular location of the array over time.

The prior art includes many examples of directional microphone array audio systems mounted as on-the-ear or in-the-ear hearing aids, eye glasses, head bands, and necklaces that sought to allow individuals with single-sided deafness or other particular hearing impairments to understand and participate in conversations in noisy environments. Among the devices proposed in the prior art is one known as a cross-aid device. This device consists basically of a subminiature microphone located on the user's deaf side, with the amplified sound carried to the good ear. However, this device is ineffective when significant ambient or multi-directional noise is present. Other efforts in the prior art have been largely directed to the use of moving, rotatable conduits that can be turned in the direction that the listener wishes to emphasize (see e.g. U.S. Pat. No. 3,983,336). Alternatively, efforts have also been made in using movable plates and grills to change the acoustic resistance and thus the directive effect of a directional hearing aid (see e.g. U.S. Pat. No. 3,876,843 to Moen). Efforts have been made to increase directional properties, see U.S. Pat. No. 4,751,738 to Widrow et al., and U.S. Pat. No. 5,737,430 to Widrow; however, these efforts display shortcomings in the categories of awkward or uncomfortable mounting of the microphone array and associated electronics on the person, hyper-directionality, ineffective directionality, inconsistent performance across sound frequencies, inordinate hardware and software complexity, and the like.

All of these prior devices allow in too much ambient and directional noise, instead of being focused more tightly on the desired sound source(s) and significantly reducing all off-axis sounds. This is largely due to their having beam widths so wide and side lobes so large that they captured much more than the desired sound source(s). In contrast, highly directional devices must have beam widths less than or equal to 25 degrees. In addition, prior art devices have had beam widths which varied significantly over frequency (making accurate steering more demanding) and lacked sufficient directivity gain due to the small number of microphones employed in general, and the limited effective aperture of the array.

As a result of these deficiencies, commercialized hearing aids, even augmented with prior microphone array technology, are considered ineffective by a majority of users in noisy and reverberant environments, such as restaurants, cocktail parties, and sporting events. What is needed, therefore, is a wearable directional microphone array capable of effectively filtering ambient and directional noise, while being comfortably and discreetly mounted on the user.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Certain aspects of the present disclosure provide for a wearable microphone array system, comprising a garment configured to be worn on the torso of a user; a plurality of acoustic transducers being housed within or coupled to an anterior portion of the garment, wherein the plurality of acoustic transducers are operably engaged to comprise an array and configured to receive an acoustic audio input, wherein the array comprises one or more channels; an integral or remote audio processing module communicably engaged with the plurality of acoustic transducers via a bus or wireless communications interface to receive the acoustic audio input, the audio processing module comprising at least one processor and a non-transitory computer readable medium having instructions stored thereon that, when executed, cause the processor to perform one or more spatial audio processing operations, the one or more spatial audio processing operations comprising processing the acoustic audio input to generate an acoustic propagation model for a target audio source within at least one source location; processing the acoustic audio input according to the acoustic propagation model to spatially filter and extract a target audio signal from the acoustic audio input; applying a whitening filter to the target audio signal, wherein the whitening filter is configured to whiten the target audio signal and suppress non-target audio signals from the acoustic audio input; and outputting a digital audio output comprising the target audio signal.

In accordance with certain aspects of the present disclosure, the wearable microphone array system may be configured wherein the plurality of acoustic transducers are arranged in a multi-armed logarithmic spiral configuration.

In some embodiments, each arm of the multi-armed logarithmic spiral configuration may comprise a separate audio input channel. The plurality of acoustic transducers comprises four or more transducers.

In accordance with certain aspects of the present disclosure, the wearable microphone array system may be configured wherein processing the acoustic audio input to generate an acoustic propagation model comprises calculating a normalized cross power spectral density for the acoustic audio input. In such embodiments, the system may be configured to process the acoustic audio input to generate an acoustic propagation model to calculate one or more boundary conditions for the at least one source location. The system may be configured such that calculating the one or more boundary conditions for the at least one source location comprises estimating a Greens Function for the at least one source location. The system may be further configured to process the acoustic audio input to convert the acoustic audio input from a time domain to a frequency domain to generate an acoustic propagation model. In such embodiments, the digital audio output may comprise converting the target audio signal from the frequency domain to the time domain according to a transform equation.

In accordance with certain aspects of the present disclosure, the one or more audio processing operations may further comprise processing the acoustic audio input to determine an audio signal with a greatest signal strength within the acoustic audio input. In accordance with some embodiments, the audio signal with the greatest signal strength may define the target audio source for the acoustic propagation model.

Further aspects of the present disclosure provide for a wearable microphone array system, comprising a garment configured to be worn on the torso of a user; a flexible printed circuit board being housed in an interior portion of the garment, the flexible printed circuit board comprising a multi-armed logarithmic spiral configuration; a plurality of acoustic transducers comprising an array, each transducer in the plurality of transducers being mounted on a surface of the flexible printed circuit board and configured to receive an acoustic audio input; an integral or remote audio processing module communicably engaged with the plurality of acoustic transducers via a bus or wireless communications interface to receive the acoustic audio input, the audio processing module comprising at least one processor and a non-transitory computer readable medium having instructions stored thereon that, when executed, cause the processor to perform one or more spatial audio processing operations, the one or more spatial audio processing operations comprising processing the acoustic audio input to generate an acoustic propagation model for a target audio source within at least one source location; processing the acoustic audio input according to the acoustic propagation model to spatially filter and extract a target audio signal from the acoustic audio input; applying a whitening filter to the target audio signal, wherein the whitening filter is configured to whiten the target audio signal and suppress non-target audio signals from the acoustic audio input; and outputting a digital audio output comprising the target audio signal.

In accordance with certain embodiments of the present disclosure, the wearable microphone array system may further comprise at least one audio output device communicably engaged with the audio processing module to output the digital audio, wherein the at least one audio output device comprises headphones, earbuds, or hearing aids. In some embodiments, each arm of the multi-armed logarithmic spiral configuration may comprise a separate audio input channel for the array; for example, the array may comprise four or more audio input channels. In accordance with certain embodiments, the flexible printed circuit board may comprise a first panel and a second panel. In some embodiments, the system may further comprise an input device communicably engaged with the audio processing module and configured to select a target audio source in response to a user input In accordance with certain embodiments of the present disclosure, the wearable microphone array system may be configured wherein the one or more audio processing operations further comprise processing the acoustic audio input to determine an audio signal with a greatest signal strength within the acoustic audio input. In such embodiments, the system may be configured wherein the audio signal with the greatest signal strength defines the target audio source for the acoustic propagation model.

Still further aspects of the present disclosure provide for a non-transitory computer-readable medium encoded with instructions for commanding one or more processors to execute operations for spatial audio processing, the operations comprising receiving an acoustic input from a wearable directional microphone array; processing the acoustic audio input to generate an acoustic propagation model for a target audio source within at least one source location; processing the acoustic audio input according to the acoustic propagation model to spatially filter and extract a target audio signal from the acoustic audio input; applying a whitening filter to the target audio signal, wherein the whitening filter is configured to whiten the target audio signal and suppress non-target audio signals from the acoustic audio input; and outputting a digital audio output comprising the target audio signal.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The skilled artisan will understand that the figures, described herein, are for illustration purposes only. It is to be understood that in some instances various aspects of the described implementations may be shown exaggerated or enlarged to facilitate an understanding of the described implementations. In the drawings, like reference characters generally refer to like features, functionally similar and/or structurally similar elements throughout the various drawings. The drawings are not necessarily to scale, emphasis instead being placed upon illustrating the principles of the teachings. The drawings are not intended to limit the scope of the present teachings in any way. The system and method may be better understood from the following illustrative description with reference to the following drawings in which.

DETAILED DESCRIPTION

Figure 1:
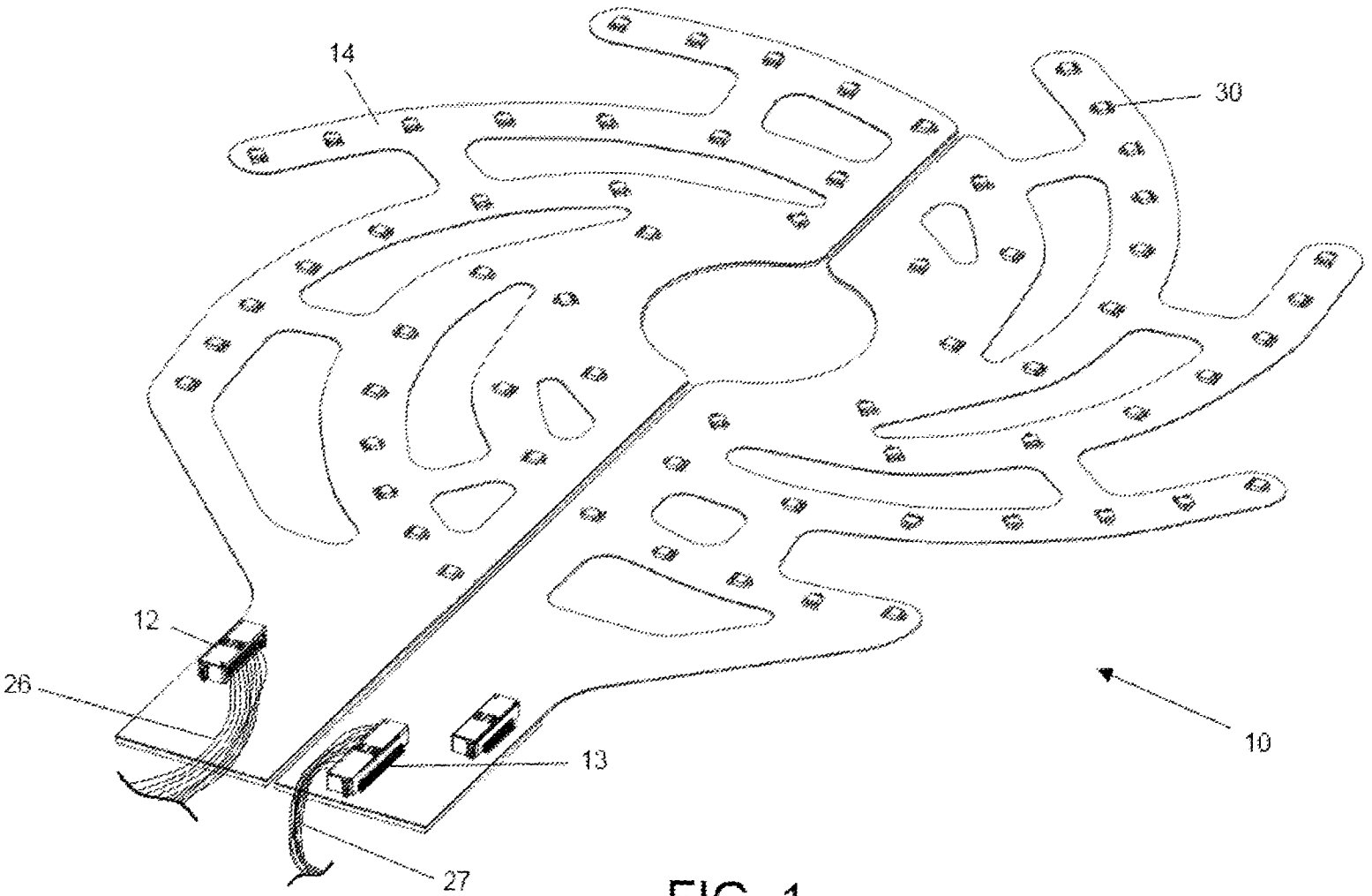
FIG. 1 is a perspective view of a wearable microphone array apparatus, in accordance with certain aspects of the present disclosure.

Before the present invention and specific exemplary embodiments of the invention are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, exemplary methods and materials are now described. All publications mentioned herein are incorporated herein by reference to disclose and describe the methods and/or materials in connection with which the publications are cited.

It must be noted that as used herein and in the appended claims, the singular forms "a," "an," and "the" include plural referents unless the context clearly dictates otherwise. Thus, for example, reference to "a transducer" includes a plurality of such transducers and reference to "the signal" includes reference to one or more signals and equivalents thereof known to those skilled in the art, and so forth.

The publications discussed herein are provided solely for their disclosure prior to the filing date of the present application. Nothing herein is to be construed as an admission that the present invention is not entitled to antedate such publication by virtue of prior invention. Further, the dates of publication provided may differ from the actual publication dates which may need to be independently confirmed.

As used herein, "exemplary" means serving as an example or illustration and does not necessarily denote ideal or best.

As used herein, the term "includes" means includes but is not limited to, the term "including" means including but not limited to. The term "based on" means based at least in part on.

As used herein the term "sound" refers to its common meaning in physics of being an acoustic wave. It therefore also includes frequencies and wavelengths outside of human hearing.

As used herein the term "signal" refers to any representation of sound whether received or transmitted, acoustic or digital, including desired speech or other sound source.

As used herein the term "noise" refers to anything that interferes with the intelligibility of a signal, including but not limited to background noise, competing speech, non-speech acoustic events, resonance reverberation (of both desired speech and other sounds), and/or echo.

As used herein the term Signal-to-Noise Ratio (SNR) refers to the mathematical ratio used to compare the level of desired signal (e.g., desired speech) to noise (e.g., background noise). It is commonly expressed in logarithmic units of decibels.

In accordance with various aspects of the present disclosure, recorded audio from an array of transducers (including microphones and other electronic devices) may be utilized instead of live input.

In accordance with various aspects of the present disclosure, waveguides may be used in conjunction with acoustic transducers to receive sound from or transmit sound to an acoustic space. Arrays of waveguide channels may be coupled to a microphone or other transducer to provide additional spatial directional filtering through beamforming. A transducer may also be employed without the benefit of waveguide array beamforming, although some directional benefit may still be obtained through "acoustic shadowing" that is caused by sound propagation being hindered along some directions by the physical structure that the waveguide is within.

In accordance with various aspects of the present disclosure, the spatial audio array processing system may be implemented in a receive-only, transmit-only, or bi-directional embodiments as the acoustic Green's Function models employed are bi-directional in nature.

Certain aspects of the present disclosure provide for a spatial audio processing system and method that does not require knowledge of an array configuration or orientation to improve SNR in a processed audio output. Certain objects and advantages of the present disclosure may include a significantly greater (15 dB or more) SNR improvements relative to beamforming and/or noise reduction speech enhancement approaches. In certain embodiments, an exemplary system and method according to the principles herein may utilize four or more input acoustic channels and as one or more output acoustic channel to derive SNR improvements.

Certain objects and advantages include providing for a spatial audio processing system and method that is robust to changes in an acoustic environment and capable of providing undistorted human speech and other quasi-stationary signals. Certain objects and advantages include providing for a spatial audio processing system and method that requires limited audio learning data; for example, two seconds (cumulative).

In various embodiments, an exemplary system and method according to the principles herein may process audio input data to calculate/estimate, and/or use one or more machine learning techniques to learn, an acoustic propagation model between a desired location of a sound source relative to one or more array elements within an acoustic space. In certain embodiments, the one or more array elements may be co-located and/or distributed transducer elements.

Embodiments of the present disclosure are configured to accommodate for suboptimal acoustic propagation environments (e.g., large reflective surfaces, objects located between the desired acoustic location and the transducers that interfere with the free-space propagation, and the like) by processing audio input data according to a data processing framework in which a Green's function including one or more boundary conditions is applied to derive an acoustic propagation model for an acoustic location or environment.

In various embodiments, an exemplary system and method according to the principles herein may utilize one or more audio modeling, processing, and/or rendering framework comprising a combination of a Green's Function algorithm and whitening filtering to derive an optimum solution to the Acoustic Wave Equation for the subject acoustic space. Certain advantages of the exemplary system and method may include enhancement of a desired acoustic location within the subject acoustic space, with simultaneous reduction in all other the subject acoustic locations. Certain embodiments enable projection of cancelled sound to a desired location for noise control applications, as well as remote determination of residue to use in adaptively canceling sound in a desired location.

In various embodiments, an exemplary system and method according to the principles herein is configured to construct an acoustic propagation model for a desired acoustical location containing a point source within a linear acoustical system. In accordance with various aspects of the present disclosure, no significant practical constraints other than a point source within a linear acoustical system are imposed to construct the acoustic propagation model, such as (realizable) dimensionality (e.g., 3D acoustic space), transducer locations or distributions, spectral properties of the sources, and initial and boundary conditions (e.g., walls, ceilings, floor, ground, or building exteriors). Certain embodiments provide for improved SNR in a processed audio output even under "underdetermined" acoustic conditions, i.e., conditions having more noise sources than microphones.

Certain exemplary devices, systems and methods of the present disclosure provide for a wearable microphone array system configured to spatially process a target audio signal from a point source within a three-dimensional acoustic space. In certain embodiments, the target audio signal is a human voice associated with a person speaking to the wearer of the wearable microphone array system within the acoustic space. The exemplary wearable microphone array system is configured to receive an audio input comprising the speaker's voice, spatially process the audio input to extract and whiten the speaker's voice from the audio input and suppress other audio signals being present within the audio input, and render/output a digital audio output comprising the processed target audio signals. In certain embodiments, the system is configured to output the digital audio output to headphones or a hearing aid.

Reference will now be made descriptively to the drawings, in which similar reference characters denote similar elements throughout the several views. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description of various embodiments of the present invention, numerous specific details are set forth in order to provide a thorough understanding of the present invention. In other instances, well-known methods, procedures, protocols, services, components, and circuits have not been described in detail so as not to unnecessarily obscure aspects of the present invention.

FIG. 1 shows an illustration of an embodiment of the invention as a logarithmic-spiral array (also known as "log spiral") 10, constructed in such a manner as to make installation into a garment, such as a vest. The construction details of the invention as shown in FIG. 1 are a logarithmic-spiral configuration of microphones mounted on a flexible printed circuit board ("PCB") material 14 with surface-mounted microphones 30 and any necessary supporting electronic components, two inter-panel connectors 12, and an output connector 13. The PCB 14 has components mounted on either one or two sides and typically has one or more layers being a metal ground plane for radio-frequency shielding purposes. The PCB 14 typically is constructed from or coated with a low friction material to minimize sound conduction into the invention by means of mechanical rubbing. In an embodiment, surface-mounted microphones 30 may be replaced with transducers, including but not limited to, acoustic sensors, acoustic renderers, and digital transducers.

Figure 3:
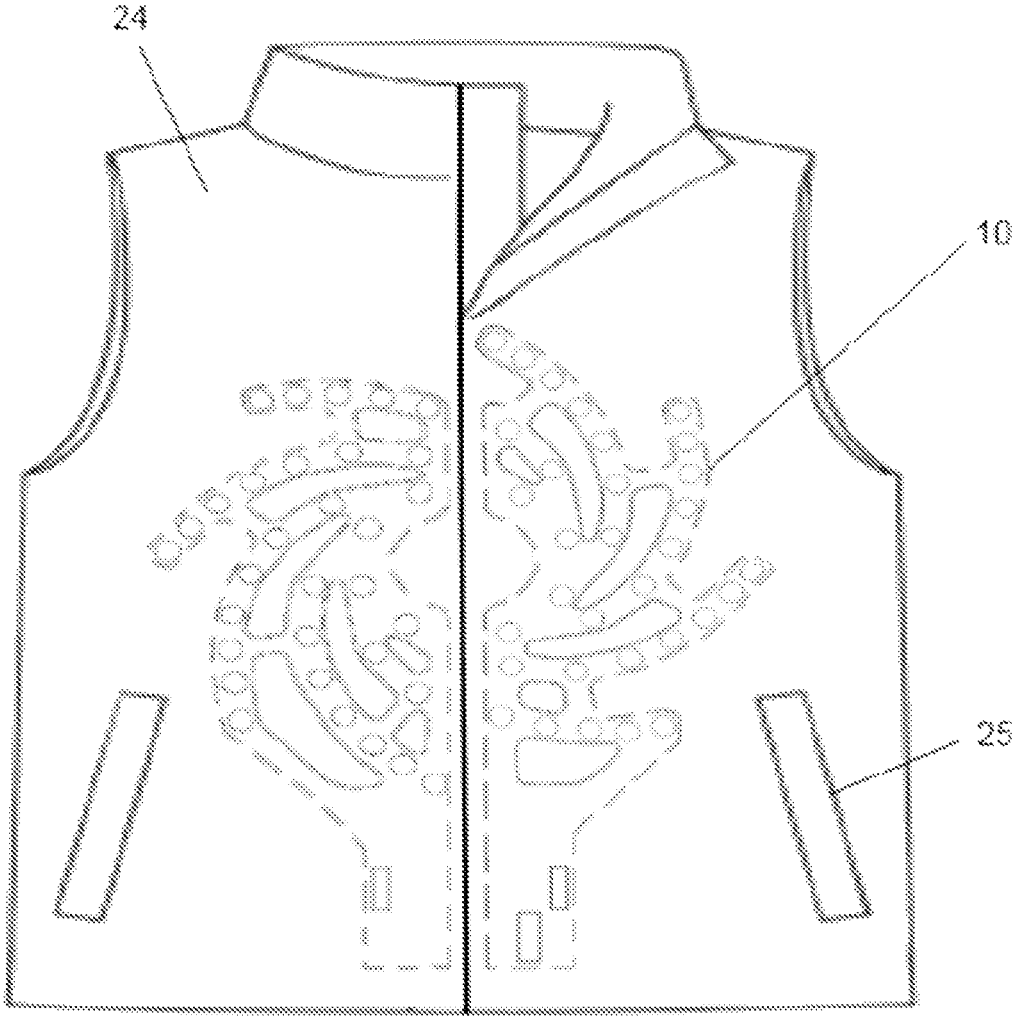
FIG. 3 is a perspective view of a wearable microphone array apparatus incorporated within a wearable garment, in accordance with certain aspects of the present disclosure.

Microphones 30, inter-panel connectors 12, output connector 13, and any other electronic components are typically mounted on one side of the PCB 14. The microphones 30 are typically arranged in what is known in some disciplines as a multiple-armed logarithmic spiral configuration with logarithmic spacing between the microphones. The microphones 30 are typically ported to the arriving sound pressure waves through tiny holes that go completely through the PCB 14, therefore the electronics are on one side of the array 10, while the smooth reverse side faces toward the sound source(s) of interest and helps minimizes mechanical rubbing noise against the fabric of the garment 24 (as shown in FIG. 3).

Other variations on this construction technique can be fabricated or easily conceived by any person skilled in the art, including but not limited to individually wired microphones arranged in the same or similar geometric pattern and mounted on or in a host device; substrates made of materials other than flexible PCB, such as hard PCB or even fabric with conductive wires, PCB traces, or other substances to electrically connect the microphones to the electronics module, power, and ground; other arrangements of microphones, such as fractal, equal, random, concentric circle, Golden Spiral, and Fibonacci spacing; and array panels 10 with vibration or sound absorbing layers of sound and vibration dampening materials (e.g. neoprene rubber or similar materials) on top and/or bottom.

Figure 2:
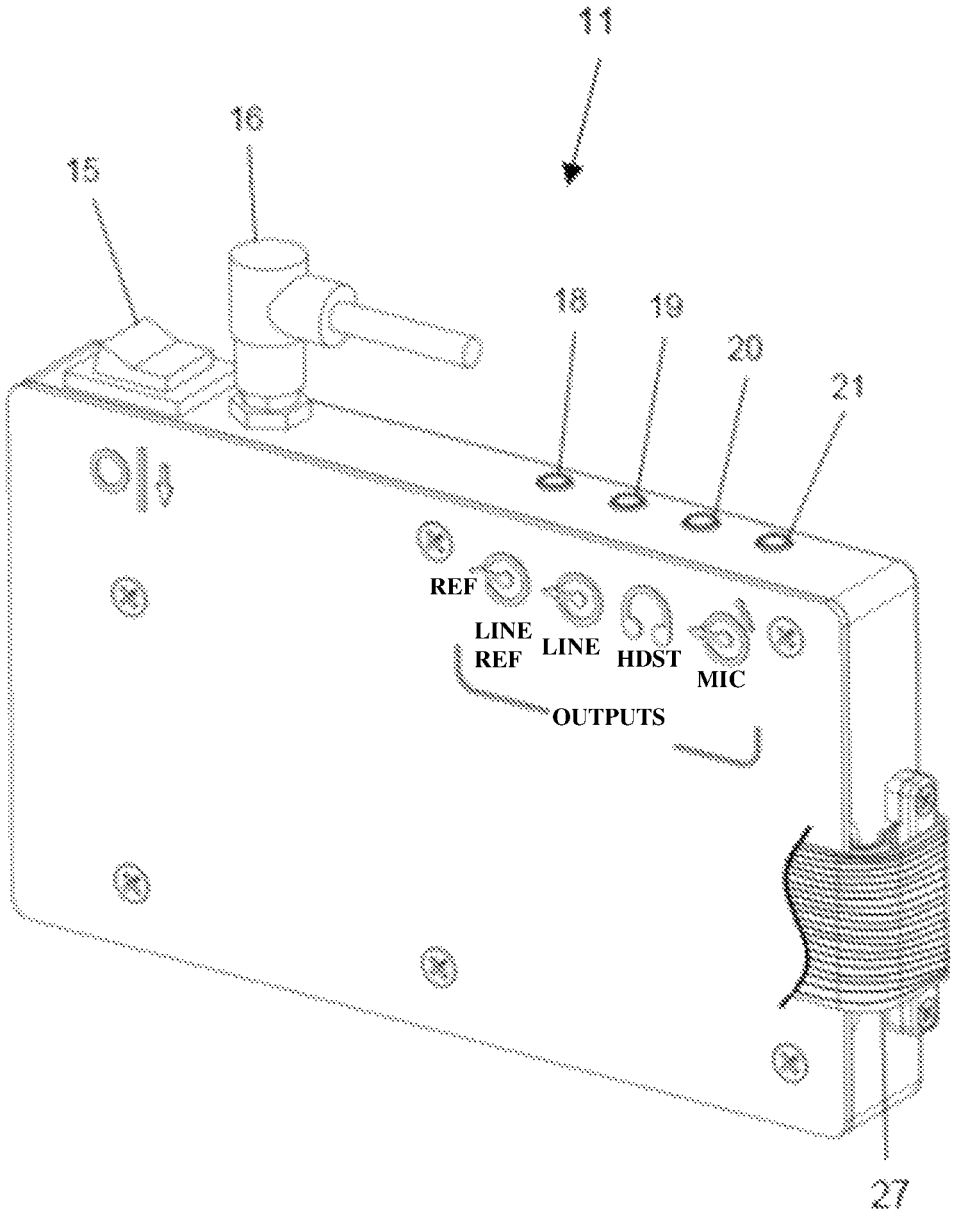
FIG. 2 is a perspective view of an audio processing module, in accordance with certain aspects of the present disclosure.

Referring now to the invention shown in FIG. 2, the electronics module 11 connects to the array panel(s) using the electrical bus coming from the output connector 13 (as shown in FIG. 1). In more detail, still referring to the invention of FIG. 2, the electronics module includes circuitry and other components to allow it to perform additional filtering, linear and automatic gain control, noise reduction filtering, and/or signal output at multiple levels, including microphone, headphone, and/or line levels. These components are well-known in the art, are not necessary for the effective functioning of the invention and need not be discussed at length here. The electronics module also provides for input and output of a general reference microphone channel that is not beamformed and provides a representation of the sounds reaching the array or its vicinity. The electronics module includes an on/off switch 15 and cable connection 16, which provides DC power from a remote battery pack or other electrical power source. In addition, the housing of electronics module 11 provides an output connection interface for a microphone 21, headset 20, line 19, and reference line 18.

In an embodiment, the construction details of the invention as shown in FIG. 2 are an external housing, encasing a multi-layer PCB with accompanying switch, electrical jacks, and wiring. The filtering and other processing performed on the PCB are accomplished using primarily analog electronic components.

Other variations on this construction technique include, but are not limited to, embedding the electronics contained in the electronics module inside of other housings or devices or directly on PCB 14; using digital electronics, including digital signal processors (DSPs), ASICs (application specific integrated circuits), FPGA (field programmable gate arrays) and similar technologies, to implement generally the same signal processing using digital devices as is being accomplished using analog and hybrid devices in an embodiment; and the use of other transducer types including but not limited to electret microphones, accelerometers, velocity transducers, acoustic vector sensors, and digital microphones (i.e. microphones with a digital output) instead of the current MEMS (micro-electromechanical systems) microphones with analog outputs.

In an embodiment, a multi-armed log spiral arrangement possesses a beam width of approximately 25 degrees across the system bandwidth; significant gain from 64 microphones; significant attenuation of the side lobes; and natural sounding quality of beamformed audio. In this embodiment, a user experiences optimal hearing quality in noisy, reverberant environments, including a narrow beam width across the system's frequency range; a relatively equal beam width across the system's frequency range; the optimal amount of gain and side lobe attenuation, and a natural quality to the resulting beamformed audio.

Referring now to the invention shown in FIG. 3 (with cross reference to FIGS. 1 and 2), the array panel (a log-spiral in an embodiment) is worn installed in an outer garment 24, such as the vest depicted in FIG. 3. In more detail, still referring to the invention of FIG. 3 of an embodiment, the array panels 10 are in each side of the zippered vest, with the two halves of the overall array connected together through the interconnection cable 26 (as shown in FIG. 1) that runs from the inter-panel connector 12 (as shown in FIG. 1) on one panel to the inter-panel connector 12 on the other. The electronics module is connected to the array panels via the output cable 27 (as shown in FIG. 2) to the output connector 13 (as shown in FIG. 1). The electronics module is carried within one pocket 25 and the batteries in the other pocket 25, so as to balance out the weight of both sides of the garment more evenly.

In an embodiment, the construction details of the invention as shown in FIG. 3 demonstrates its installation into a zippered vest garment with wired interconnection between array panels and a portable remote electronics module. Other variations on this construction technique include but are not limited to the use of wireless links to replace one or more cables; the integration of the electronics contained in the electronics module onto an array panel; the installation of the array panels into other garments, such as t-shirts, blazers, ladies' sweater vests, and the like, which may or may not have zippers and may use a short jumper cable between the array panels or be constructed of one combined array panel; the use of nanotechnology materials or other conductive fabrics and devices to both mount the components and serve as electrical connections and microphones; and the use of individually wired microphones installed directly into a garment or worn as a mesh.

Figure 4:
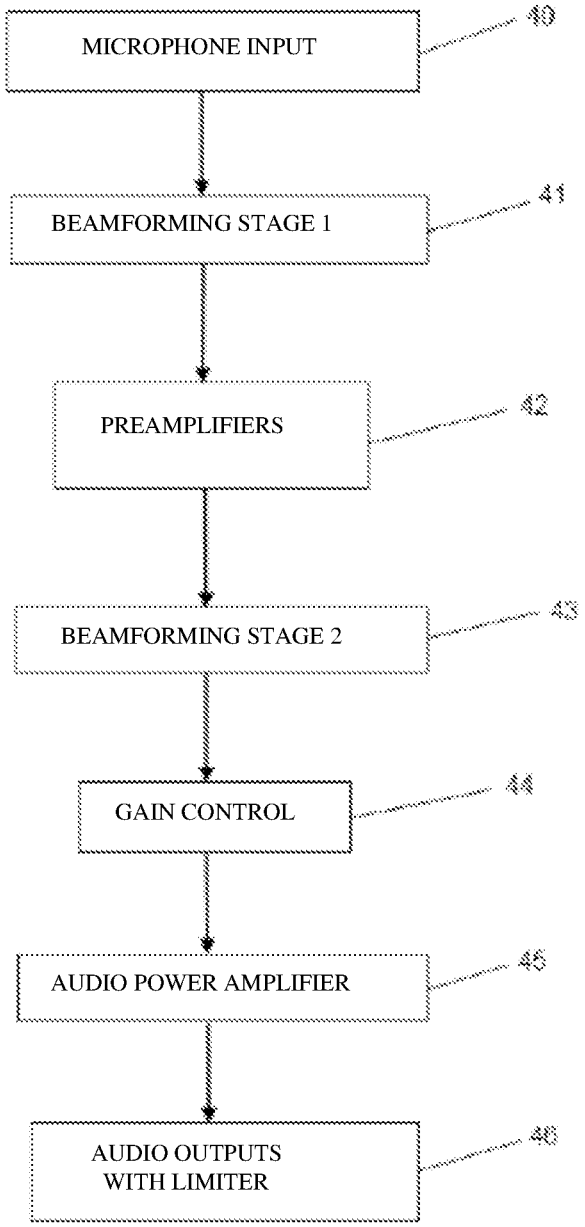
FIG. 4 is a process flow diagram of an audio processing routine, in accordance with certain aspects of the present disclosure.

Referring now to the invention shown in FIG. 4, the functional block diagram illustrates how an embodiment acquires the sounds from the environment, processes them to filter out directional sounds of interest, and outputs the directional (beamformed) sounds for the user. In more detail, still referring to the invention of FIG. 4, multiple microphones first capture the sounds at the array 40 and the microphone signals are beamformed in groups in a first stage of beamforming 41 directly on the electrical bus of the array panel(s) 10 into multiple channels. In the electronics module 11 the pre-beamformed channels are then amplified 42 and then beamformed again in a second stage of beamforming 43. Linear or automatic gain control (including frequency filtering) 44 and audio power amplification 45 are then applied selectively prior to the directional audio being produced at line, microphone and/or headphone level 46.

Other variations on this construction technique include adding successive stages of beamforming; alternative orders of filtering and gain control; use of reference channel signals with filtering to remove directional or ambient noises; use of time or phase delay elements to steer the directivity pattern; the separate beamforming of the two panels so that directional sounds to the left (right) are output to the left (right) ear to aid in binaural listening for persons with two-sided hearing or cochlear implant(s); and the use of one or more signal separation algorithms instead of one or more beamforming stages.

Certain aspects of the present disclosure provide for: (a) highly directional audio system as a body-worn or -carried assisted listening or hearing aid device; (b) immunity to noises caused by RF interference and mechanical rubbing; (c) low cost of construction; (d) high reliability; (e) tolerance to a wide range of temperature; (f) light weight; (g) simplicity of operation; (h) simultaneous high gain, high directivity, and high side lobe attenuation; and (i) low power consumption. Certain embodiments of the present disclosure provide for a directional microphone array used as wearable clothing or other body-worn or -carried assisted listening or hearing aid device.

Figure 5:
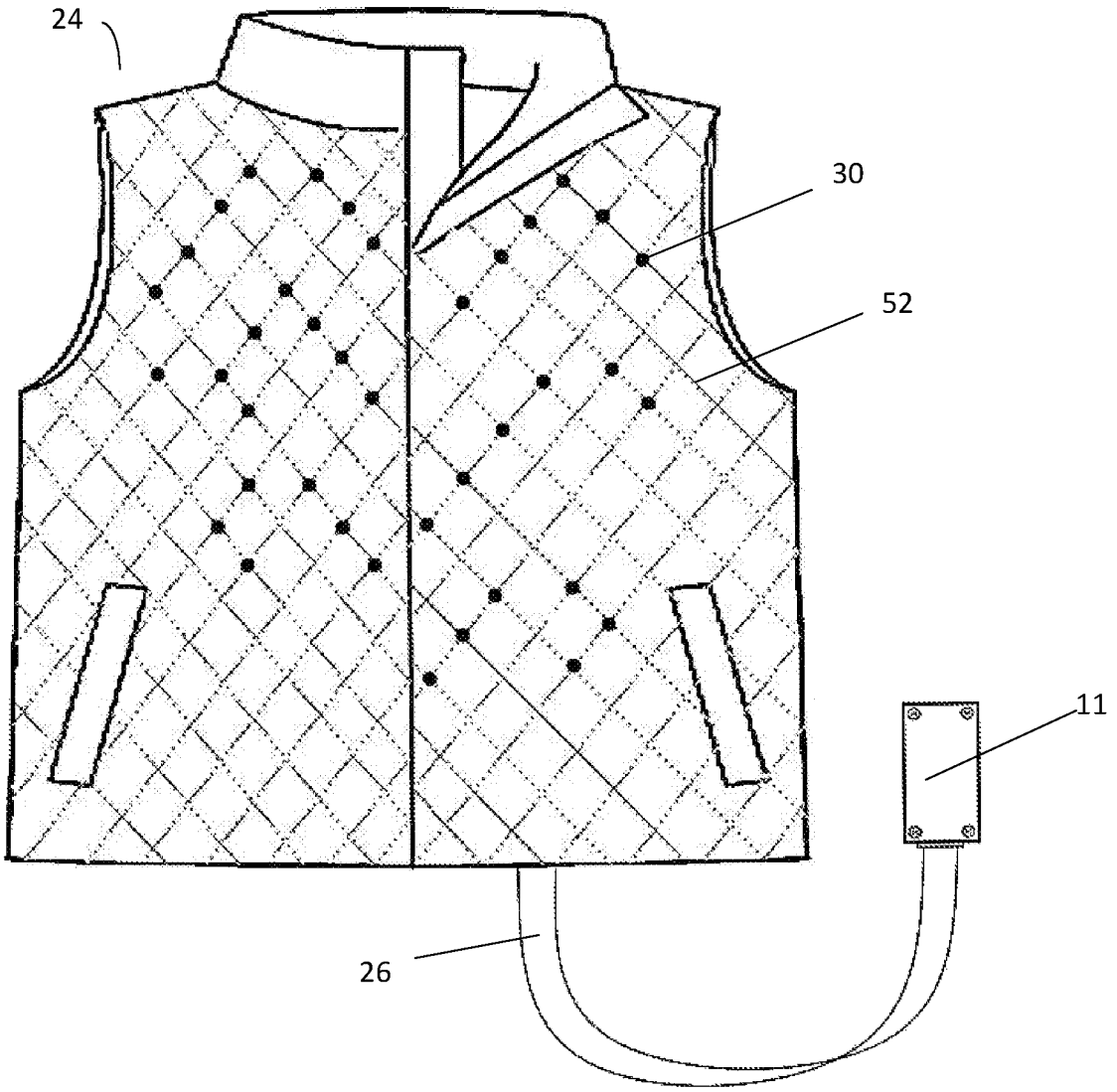
FIG. 5 is a perspective view of a wearable microphone array apparatus incorporated within a wearable garment, in accordance with certain aspects of the present disclosure.

FIG. 5 is an alternative embodiment as described by the construction details discussed in FIG. 3. Microphones 30 are coupled to garment 24 and operably connected by electrical connections 52. Electrical connections 52 may be nanotechnology materials or other conductive fabrics as described in FIG. 3. Electrical connections 52 may be operably connected to electronics module 11 through interconnection cable 26. Signal output from microphones 30 may be communicated to electronics module 11 via electrical connections 52.

Figure 6:
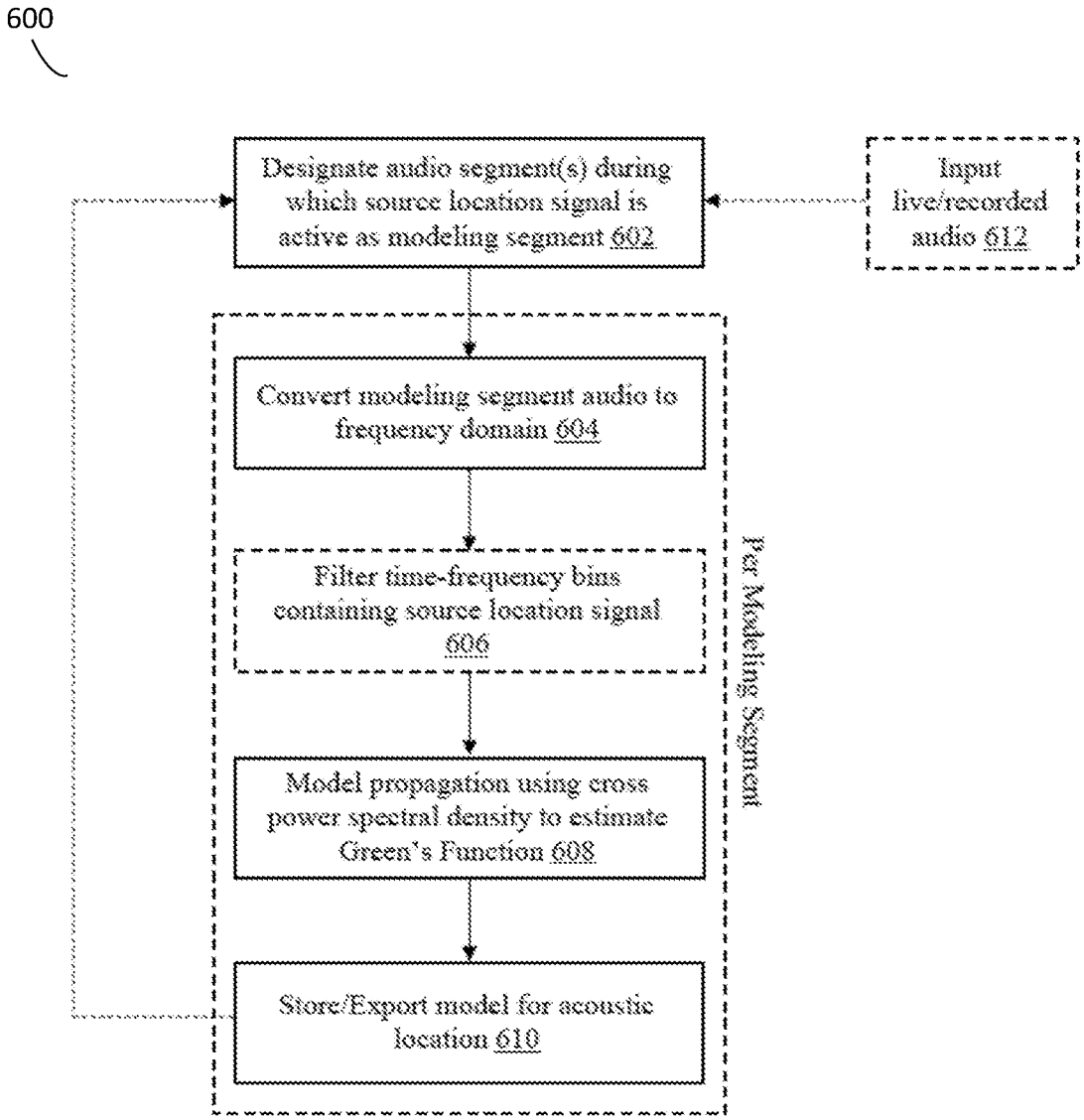
FIG. 6 is a process flow diagram of a routine for generating an acoustic propagation model, in accordance with certain aspects of the present disclosure.

Referring now to FIG. 6, a process flow diagram of a modeling routine 600 is shown. In accordance with certain aspects of the present disclosure, routine 600 may be implemented in or otherwise embodied as a component of a wearable microphone array system; for example, the wearable microphone array system as shown and described in FIGS. 1-5. According to an embodiment, modeling routine 600 is initiated by inputting or selecting one or more audio segments during which a target sound source is active (e.g. as a modeling segment) 602 to derive a target audio input or training audio input. In the context of modeling routine 600, this may be referred to as "glimpsing" the training audio data. The one or more audio segments (i.e. the "glimpsed" audio data) may be derived from a live or recorded audio input 612 corresponding to an acoustic location or environment (e.g. an interior room in a building, such as a conference room or lecture hall). In certain embodiments, modeling routine 600 is initiated by designating one or more audio segments during which a source location signal is active as a modeling segment 602. In certain embodiments, the one or more audio segments to be modeled can be designated manually (i.e. selected) or may be designated algorithmically and/or through a Rules Engine or other decision criteria, such as source location estimation, audio level, or visual triggering. In certain embodiments where visual triggering is employed, a spatial audio processing system (e.g. as shown and described in FIG. 1) may include a video camera or motion sensor configured to identify activity or sound source location as a trigger for designating the audio segment.

Modeling routine 600 may proceed by converting the target audio input or training audio input to the frequency domain 604. In some embodiments, the routine converts the target audio input or training audio input from the time domain to the frequency domain via a transform such as the Fast Fourier transform or Short Time Fourier transform. However, different transform functions may be employed to convert the target audio input or training audio input from the time domain to the frequency domain. Modeling routine 600 is configured to select and/or filter time-frequency bins containing sufficient source location signal 606 and model propagation of the source signal using normalized cross power spectral density to estimate a Green's Function for the source signal 608. The propagation model and the Green's Function estimate for the acoustic location is then exported and stored for use in audio processing 610. The propagation model and the Green's Function estimate for the acoustic location may be utilized in real-time for live audio formats. Steps 604, 606, and 608 may be executed on a per frame of data basis and/or per modeling segment.

Figure 7:
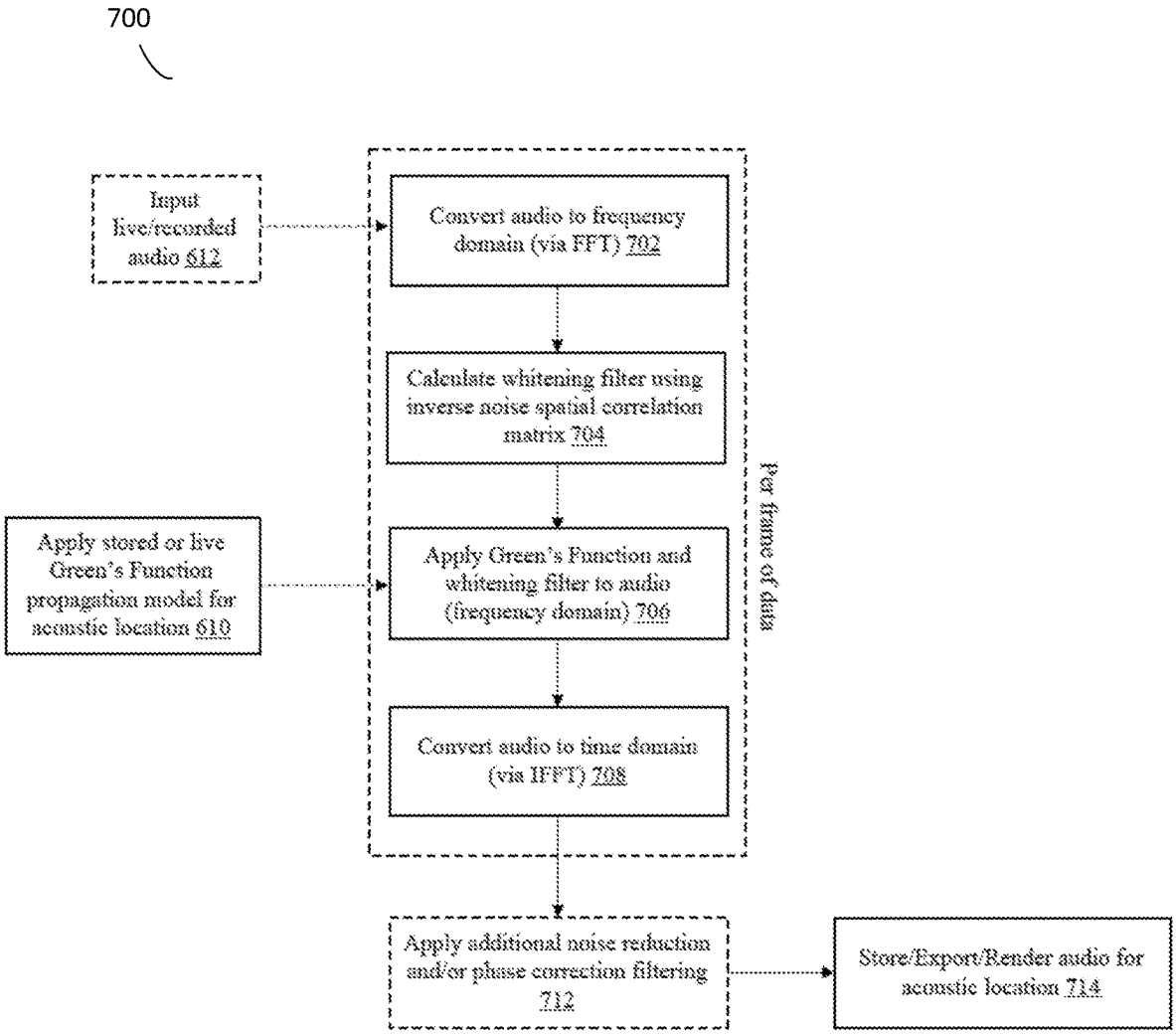
FIG. 7 is a process flow diagram of a routine for spatially processing an acoustic audio input, in accordance with certain aspects of the present disclosure.

Referring now to FIG. 7, a process flow diagram of a processing routine 700 is shown. In accordance with certain aspects of the present disclosure, routine 700 may be implemented or otherwise embodied as a component of a wearable microphone array system; for example, the wearable microphone array system as shown and described in FIGS. 1-5. In certain embodiments, routine 700 may be sequential or successive to one or more steps of routine 600 (as shown and described in FIG. 6). According to an embodiment, processing routine 700 may be initiated by converting a live or recorded audio input 612 from an acoustic location or environment from a time domain to a frequency domain 702. In certain embodiments, routine 700 may execute step 702 by processing audio input 612 using a transform function, e.g., a Fourier transform, Fast Fourier transform, or Short Time Fourier transform, and the like. Processing routine 700 proceeds by calculating a whitening filter using inverse noise spatial correlation matrix 704 and applying the Green's Function estimate and whitening filter to the audio input within the frequency domain 706 to extract the target audio frequencies/signals and suppress the non-target frequencies/signals (i.e., noise) from the live or recorded audio input. The Green's Function estimate may be derived from the stored or live Green's Function propagation model for the acoustic location derived from step 610 of routine 600. Routine 700 may then proceed to convert the target audio frequencies back to a time domain via an inverse transform 708, such as an Inverse Fast Fourier transform. In certain embodiments, routine 700 may proceed by further processing the live or recorded audio input to apply one or more noise reduction and/or phase correction filter(s) 712 to the target audio frequencies/signals. This may be accomplished using conventional spectral subtraction or other similar noise reduction and/or phase correction techniques. Routine 700 may conclude by storing, exporting, and/or rendering an audio output comprising the extracted and whitened target audio frequencies/signals derived from the live or recorded audio input corresponding to the acoustic location or environment 714. In certain embodiments, routine 700 may be configured to execute steps 702, 704, 706, and 708 on a per frame of audio data basis.

Figure 8:
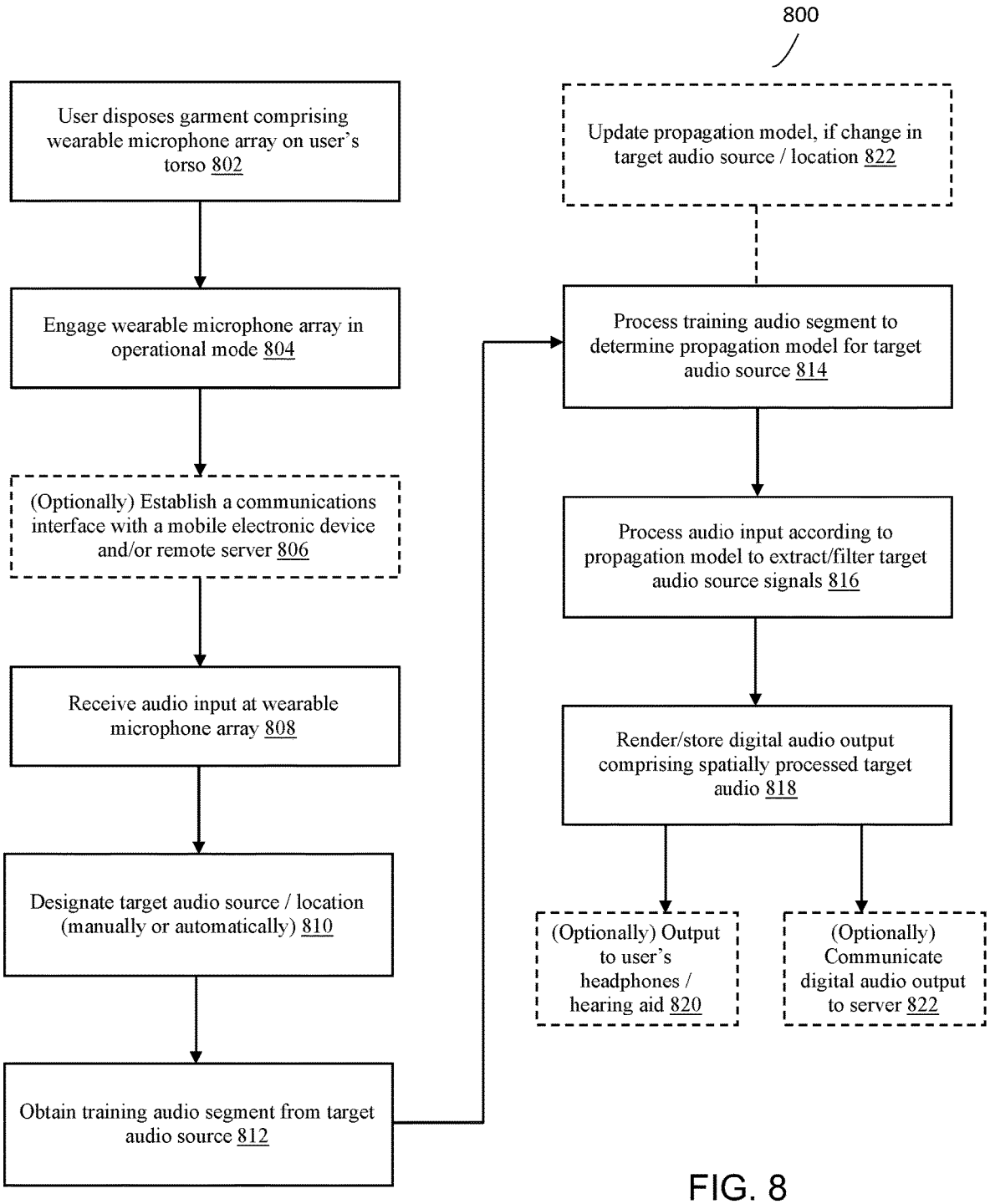
FIG. 8 is a process flow chart of a spatial audio processing method incorporated within a wearable microphone system.

Referring now to FIG. 8, a process flow chart of a spatial audio processing method 800 incorporated within a wearable microphone system is shown. In accordance with certain aspects of the present disclosure, method 800 may be comprised of method steps 802-822 and may be implemented or otherwise embodied as a component of a wearable microphone array system; for example, the wearable microphone array system as shown and described in FIGS. 1-5. In accordance with an embodiment, a user disposes a garment comprising a wearable microphone array apparatus on the user's torso (step 802). The user engages the wearable microphone array apparatus in an operational mode (step 804) in order to provide power to the microphone array and enable the system to receive an acoustic audio input at the microphone array. In certain embodiments, the system may establish a wireless communications interface with a mobile electronic device and/or remote server (step 806). Upon engaging the wearable microphone array apparatus in an operational mode (step 804), method 800 may continue by receiving an acoustic audio input at the microphone array (step 808). In certain embodiments, the acoustic audio input may be derived from an environmental or physical location in which one or more human speakers are present; for example, a restaurant or a classroom. Method 800 may continue by designating a target audio source and/or location within the acoustic audio input (step 810). A target audio source may include, for example, a specific human speaker within the environmental or physical location. A target audio location may include, for example, a specific location in which the speaker or other target audio source may be active, such as a podium in a classroom. In accordance with certain embodiments, step 810 may be configured to designate the target audio source/location automatically by performing a first stage of processing to determine the loudest/strongest source signal present within the acoustic audio input and assign the signal as the target audio source/location. In other embodiments, step 810 may be configured to designate the target audio source/location manually in response to a user pressing a button (or some other user input means) when the target audio source is active in the acoustic audio input. Once the target audio source is identified within the acoustic audio input (step 810), method 800 may continue by obtaining a training audio segment from the target audio source (step 812). The training audio segment may then be processed to determine an acoustic propagation model for the target audio source within the environmental or physical location (step 814). In accordance with certain embodiments, step 814 comprises routine 600, as shown and described in FIG. 6. In certain embodiments, method 800 is configured to obtain a new training audio segment and update the propagation model if there is a change in the target audio source or the location of the target audio source (step 822); for example, the user desires to select a new speaker as the target audio source and/or the target audio source moves to a different position within the environmental or physical location. Method 800 may execute step 822 automatically by analyzing one or more spatial or spectral characteristics of the target audio source within the acoustic audio input to verify the accuracy of the propagation model. Alternatively, method 800 may execute step 822 manually in response to a user input being configured to select a new target audio source. Method 800 may continue by continuously processing the acoustic audio input (when target audio source is active) according to the propagation model to spatially extract target audio source signals from the acoustic audio input and apply a whitening filter to the target audio source signals (step 816). In accordance with certain embodiments, step 816 comprises routine 700, as shown and described in FIG. 7. Method 800 may continue by rendering and/or storing a digital audio output comprising the spatially processed target audio signals (step 818). In certain embodiments, method 800 may be further configured to output the digital audio output of step 818 to headphones or a hearing aid of the user/wearer of the wearable microphone array system/apparatus (step 820). In certain embodiments, method 800 may be further configured to communicate the digital audio output of step 818 to a remote server for storage, further processing, and/or output to one or more audio output devices.

As the phrases are used herein, a processor may be "operable to" or "configured to" perform a certain function in a variety of ways, including, for example, by having one or more general-purpose circuits perform the function by executing particular computer-executable program code embodied in computer-readable medium, and/or by having one or more application-specific circuits perform the function.

The terms "program" or "software" are used herein in a generic sense to refer to any type of computer code or set of computer-executable instructions that can be employed to program a computer or other processor to implement various aspects of the present technology as discussed above. Additionally, it should be appreciated that according to one aspect of this embodiment, one or more computer programs that when executed perform methods of the present technology need not reside on a single computer or processor, but may be distributed in a modular fashion amongst a number of different computers or processors to implement various aspects of the present technology.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." As used herein, the terms "right," "left," "top," "bottom," "upper," "lower," "inner" and "outer" designate directions in the drawings to which reference is made.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of" or "exactly one of" "Consisting essentially of" when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A wearable microphone array system, comprising:

a garment configured to be worn on the torso of a user;

a plurality of acoustic transducers being housed within or coupled to an anterior portion of the garment, wherein the plurality of acoustic transducers are operably engaged to comprise an array and configured to receive an acoustic audio input, wherein the array comprises one or more channels;

an integral or remote audio processing module communicably engaged with the plurality of acoustic transducers via a bus or wireless communications interface to receive the acoustic audio input, the audio processing module comprising at least one processor and a non-transitory computer readable medium having instructions stored thereon that, when executed, cause the processor to perform one or more spatial audio processing operations, the one or more spatial audio processing operations comprising:

processing the acoustic audio input to generate an acoustic propagation model for a target audio source within at least one source location;

processing the acoustic audio input according to the acoustic propagation model to spatially filter and extract a target audio signal from the acoustic audio input;

applying a whitening filter to the target audio signal, wherein the whitening filter is configured to whiten the target audio signal and suppress non-target audio signals from the acoustic audio input; and outputting a digital audio output comprising the target audio signal.

2. The system of claim 1 wherein the plurality of acoustic transducers are arranged in a multi-armed logarithmic spiral configuration.

3. The system of claim 2 wherein each arm of the multi-armed logarithmic spiral configuration comprises a separate audio input channel.

4. The system of claim 1 wherein the plurality of acoustic transducers comprises four or more transducers.

5. The system of claim 1 wherein processing the acoustic audio input to generate an acoustic propagation model comprises calculating a normalized cross power spectral density for the acoustic audio input.

6. The system of claim 5 wherein processing the acoustic audio input to generate an acoustic propagation model comprises calculating a Green's Function for the at least one source location.

7. The system of claim 6 wherein the one or more spatial audio processing operations further comprise storing, on the non-transitory computer readable medium, the Green's Function for the at least one source location.

8. The system of claim 1 wherein processing the acoustic audio input to generate an acoustic propagation model comprises converting the acoustic audio input from a time domain to a frequency domain.

9. The system of claim 8 wherein outputting the digital audio output comprises converting the target audio signal from the frequency domain to the time domain.

10. The system of claim 1 wherein the one or more audio processing operations further comprise processing the acoustic audio input to determine an audio signal with a greatest signal strength within the acoustic audio input.

11. The system of claim 10 wherein the audio signal with the greatest signal strength defines the target audio source for the acoustic propagation model.

12. A wearable microphone array system, comprising:

a garment configured to be worn on the torso of a user;

a flexible printed circuit board being housed in an interior portion of the garment, the flexible printed circuit board comprising a multi-armed logarithmic spiral configuration;

a plurality of acoustic transducers comprising an array, each transducer in the plurality of transducers being mounted on a surface of the flexible printed circuit board and configured to receive an acoustic audio input;

an integral or remote audio processing module communicably engaged with the plurality of acoustic transducers via a bus or wireless communications interface to receive the acoustic audio input, the audio processing module comprising at least one processor and a non-transitory computer readable medium having instructions stored thereon that, when executed, cause the processor to perform one or more spatial audio processing operations, the one or more spatial audio processing operations comprising:

processing the acoustic audio input to generate an acoustic propagation model for a target audio source within at least one source location;

processing the acoustic audio input according to the acoustic propagation model to spatially filter and extract a target audio signal from the acoustic audio input;

applying a whitening filter to the target audio signal, wherein the whitening filter is configured to whiten the target audio signal and suppress non-target audio signals from the acoustic audio input; and outputting a digital audio output comprising the target audio signal.

13. The system of claim 12 further comprising at least one audio output device communicably engaged with the audio processing module to output the digital audio, wherein the at least one audio output device comprises headphones, earbuds, or hearing aids.

14. The system of claim 12 wherein each arm of the multi-armed logarithmic spiral configuration comprises a separate audio input channel for the array.

15. The system of claim 14 wherein the array comprises four or more audio input channels.

16. The system of claim 12 wherein the flexible printed circuit board comprises a first panel and a second panel.

17. The system of claim 12 wherein the one or more audio processing operations further comprise processing the acoustic audio input to determine an audio signal with a greatest signal strength within the acoustic audio input.

18. The system of claim 17 wherein the audio signal with the greatest signal strength defines the target audio source for the acoustic propagation model.

19. The system of claim 12 further comprising an input device communicably engaged with the audio processing module and configured to select a target audio source in response to a user input.

20. A non-transitory computer-readable medium encoded with instructions for commanding one or more processors to execute operations for spatial audio processing, the operations comprising:

receiving an acoustic input from a wearable directional microphone array;

processing the acoustic audio input to generate an acoustic propagation model for a target audio source within at least one source location;

processing the acoustic audio input according to the acoustic propagation model to spatially filter and extract a target audio signal from the acoustic audio input;

applying a whitening filter to the target audio signal, wherein the whitening filter is configured to whiten the target audio signal and suppress non-target audio signals from the acoustic audio input; and outputting a digital audio output comprising the target audio signal.

* * * * *